US008267502B2

(12) United States Patent
Onozawa et al.

(10) Patent No.: US 8,267,502 B2
(45) Date of Patent: Sep. 18, 2012

(54) INKJET PRINTER

(75) Inventors: Yoshiki Onozawa, Tomi (JP); Ryuji Yamada, Tomi (JP); Akira Minemura, Tomi (JP); Teruhisa Takano, Kobe (JP)

(73) Assignee: Mimaki Engineering Co., Ltd., Tomi-Shi (JP)

( * ) Notice: Subject to any disclaimer, the term of this patent is extended or adjusted under 35 U.S.C. 154(b) by 255 days.

(21) Appl. No.: 12/791,868

(22) Filed: Jun. 2, 2010

(65) Prior Publication Data

US 2010/0302318 A1 Dec. 2, 2010

Related U.S. Application Data

(63) Continuation of application No. PCT/JP2009/067351, filed on Oct. 5, 2009.

(30) Foreign Application Priority Data

Oct. 7, 2008 (JP) ..... 2008-260723
Oct. 7, 2008 (JP) ..... 2008-260808

(51) Int. Cl.
*B41J 2/16* (2006.01)
*B41J 2/135* (2006.01)
*B41J 2/17* (2006.01)

(52) U.S. Cl. ..... 347/51; 347/46; 347/84

(58) Field of Classification Search ..... None
See application file for complete search history.

(56) References Cited

U.S. PATENT DOCUMENTS 3,617,953 A * 11/1971 Kingma et al. ..... 333/17.1
5,631,685 A * 5/1997 Gooray et al. ..... 347/102

FOREIGN PATENT DOCUMENTS

| | | |
|---|---|---|
| JP | 60-240094 | 11/1985 |
| JP | 07-314661 | 12/1995 |
| JP | 2003-022890 | 1/2003 |
| JP | 2008-183718 | 8/2008 |

OTHER PUBLICATIONS

International Search Report for International Application No. PCT/JP2009/067351.

* cited by examiner

*Primary Examiner* — Matthew Luu
*Assistant Examiner* — Erica Lin
(74) *Attorney, Agent, or Firm* — Ditthavong Mori & Steiner, P.C.

(57) ABSTRACT

An inkjet printer includes an ejector, a wave guide, an electromagnetic wave supplier, and a reflector. The ejector is configured to eject ink toward a medium. Through the wave guide, the medium with the ink ejected by the ejector is inserted. The electromagnetic wave supplier is disposed at a start end of the wave guide to supply electromagnetic waves to the wave guide. The reflector is disposed at a terminal end of the wave guide to reflect the electromagnetic waves supplied by the electromagnetic wave supplier.

17 Claims, 19 Drawing Sheets

ROTATION ANGLE OF PROPELLER

0°

45°

90°

ROTATING

DISTANCE (mm) BETWEEN ROTATION OUTPUT SHAFT AND REFLECTIVE PLATE

| Distance between rotation output shaft and reflective plate (mm) | Distance α between extremely heated portions (mm) | Width β of extremely heated portions (mm) |
|---|---|---|
| 150 | | 44 |
| 160 | 24 | 46 |
| 170 | 22 | 49 |
| 180 | 19 | 53 |
| 190 | 23 | 44 |
| 200 | | 49 |
| 210 | | 50 |
| 220 | | 45 |
| 230 | | 50 |
| 240 | 20 | 47 |

INKJET PRINTER

CROSS-REFERENCE TO RELATED APPLICATIONS

The present application is a continuation application of International Application No. PCT/JP2009/067351, filed Oct. 5, 2009, which claims priority to Japanese Patent Application No. 2008-260723, filed Oct. 7, 2008, and Japanese Patent Application No. 2008-260808, filed Oct. 7, 2008. The contents of these applications are incorporated herein by reference in their entirety.

BACKGROUND OF THE INVENTION

1. Technical Field

The present invention relates to an inkjet printer.

2. Background Art

In an inkjet printer, printing is conducted by ejecting dye-type ink such as acid dye, reactive dye, and substantive dye or pigment-type ink containing organic solvent such as solvent ink, onto a surface or both front and back surfaces of a sheet-like medium (recording medium) made of paper, silk, cotton, vinyl chloride, or the like. Especially in the industrial field, in such an inkjet printer, it is important to effectively dry a medium after deposition of ink onto the medium in order to quickly and easily conduct shipment and delivery of the medium after printing.

For example, disclosed in JP-A-2003-022890 is an inkjet printer for drying ink deposited on a medium, by allowing the medium to move through a wave guide into which microwaves are supplied.

Though the inkjet printer disclosed in JP-A-2003-022890 can rapidly dry the ink, the inkjet printer has a disadvantage that it is necessary to make the power of the microwaves supplied to the wave guide strong or slow down the feeding speed of the medium moving through the wave guide so as to lengthen the time of irradiating the medium with microwaves because the power of the microwaves to be absorbed in the ink is not so strong.

SUMMARY OF THE INVENTION

According to one aspect of the present invention, an inkjet printer includes an ejector, a wave guide, an electromagnetic wave supplier, and a reflector. The ejector is configured to eject ink toward a medium. Through the wave guide, the medium with the ink ejected by the ejector is inserted. The electromagnetic wave supplier is disposed at a start end of the wave guide to supply electromagnetic waves to the wave guide. The reflector is disposed at a terminal end of the wave guide to reflect the electromagnetic waves supplied by the electromagnetic wave supplier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
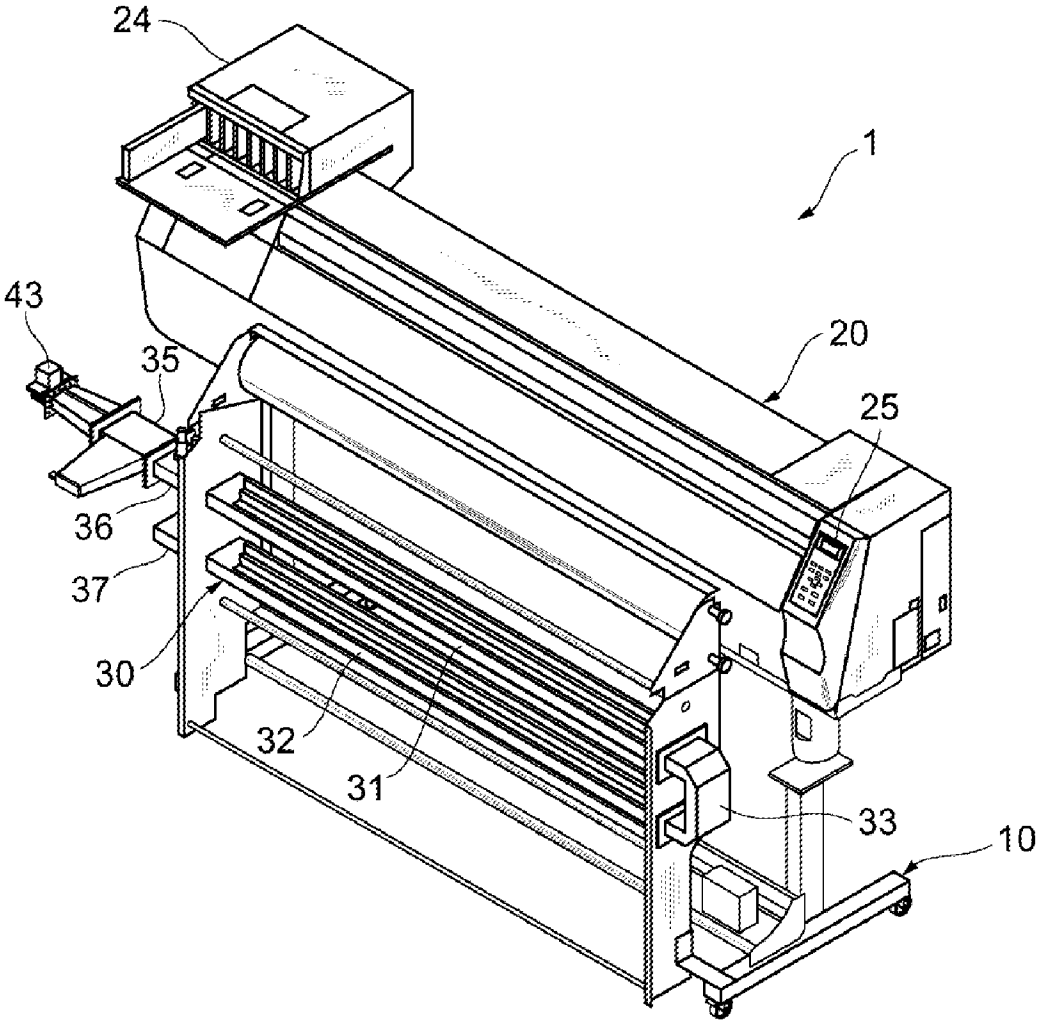
FIG. 1 is a perspective view of an inkjet printer according to a first embodiment.

Hereinafter, embodiments of the present invention will be described in detail with reference to the attached drawings. It should be noted that the same or corresponding components in the drawings are marked with the same numerals.

First Embodiment

Figure 2:
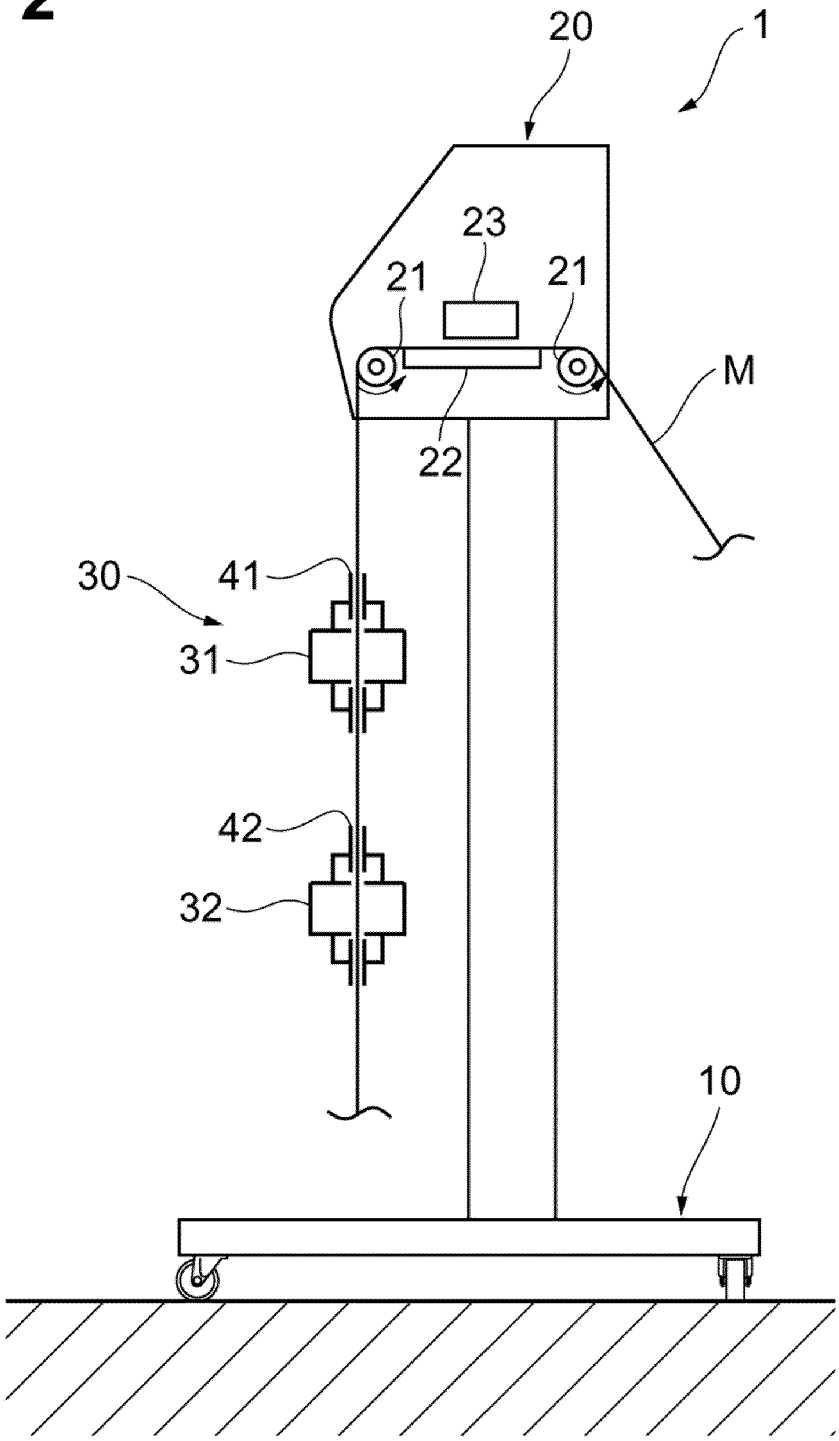
FIG. 2 is a sectional view of the inkjet printer shown in FIG. 1.

FIG. 1 is a perspective view showing an inkjet printer according to a first embodiment and FIG. 2 is a sectional view of the inkjet printer shown in FIG. 1.

As shown in FIG. 1 and FIG. 2, the inkjet printer 1 according to the first embodiment includes a printer unit 20 which is mounted on a base 10 to eject ink onto a medium M, and a wave guide 30 for drying the ink deposited on the medium M by the printer unit 20. The medium M is a sheet-like medium made of paper, silk, cotton, vinyl chloride or the like. The ink may be dye-type ink such as acid dye, reactive dye, and substantive dye or organic solvent-type ink such as solvent ink.

The printer unit 20 includes feeding rollers 21 for feeding the medium M, an inkjet head 23 for ejecting ink onto the medium M on the platen 22, a toner section 24 in which ink to be ejected from the inkjet head 23 is stored, and an operation section 25 for allowing the manipulated input of a user.

Figure 3:
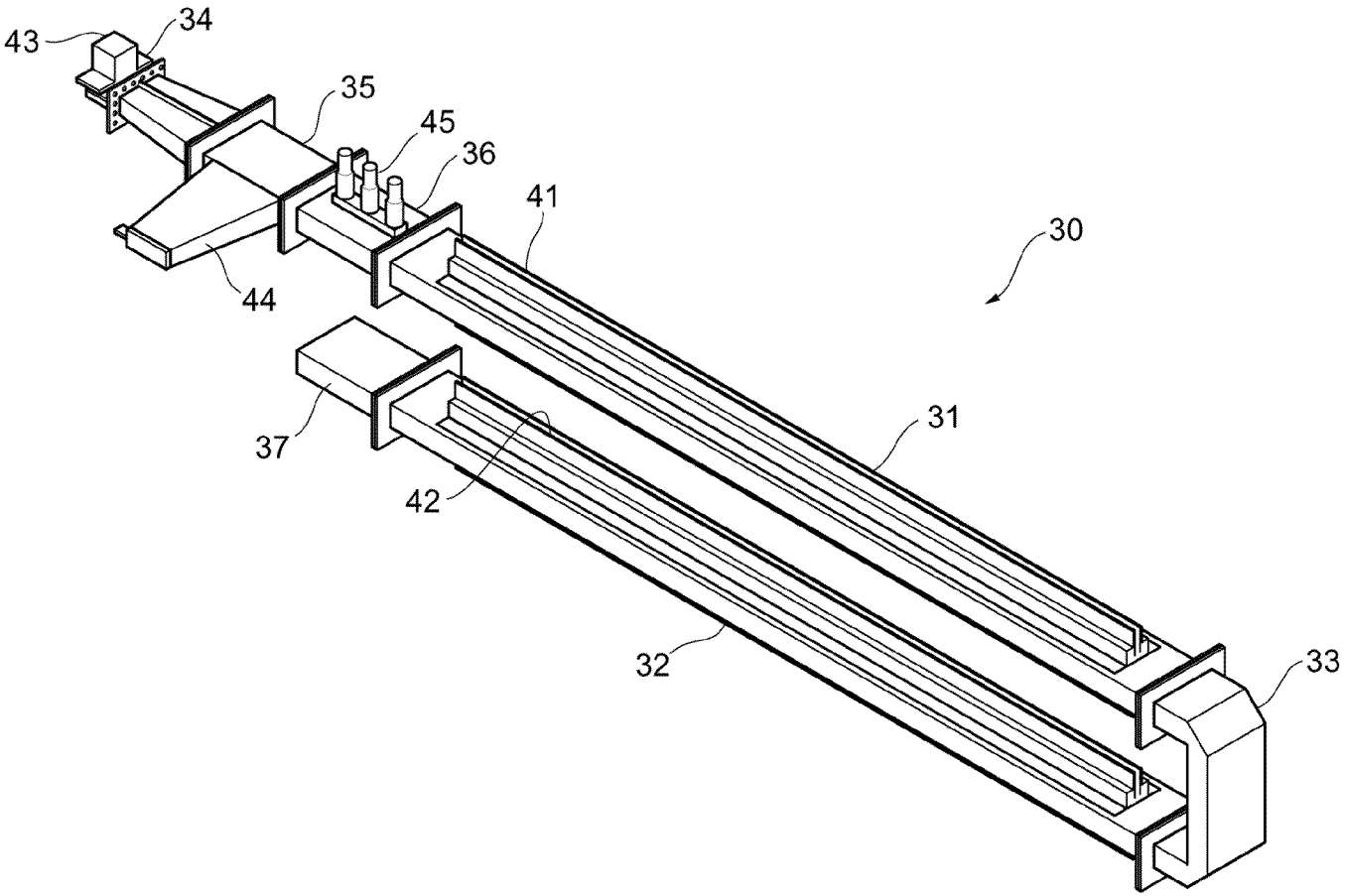
FIG. 3 is a perspective view of a wave guide.
Figure 4:
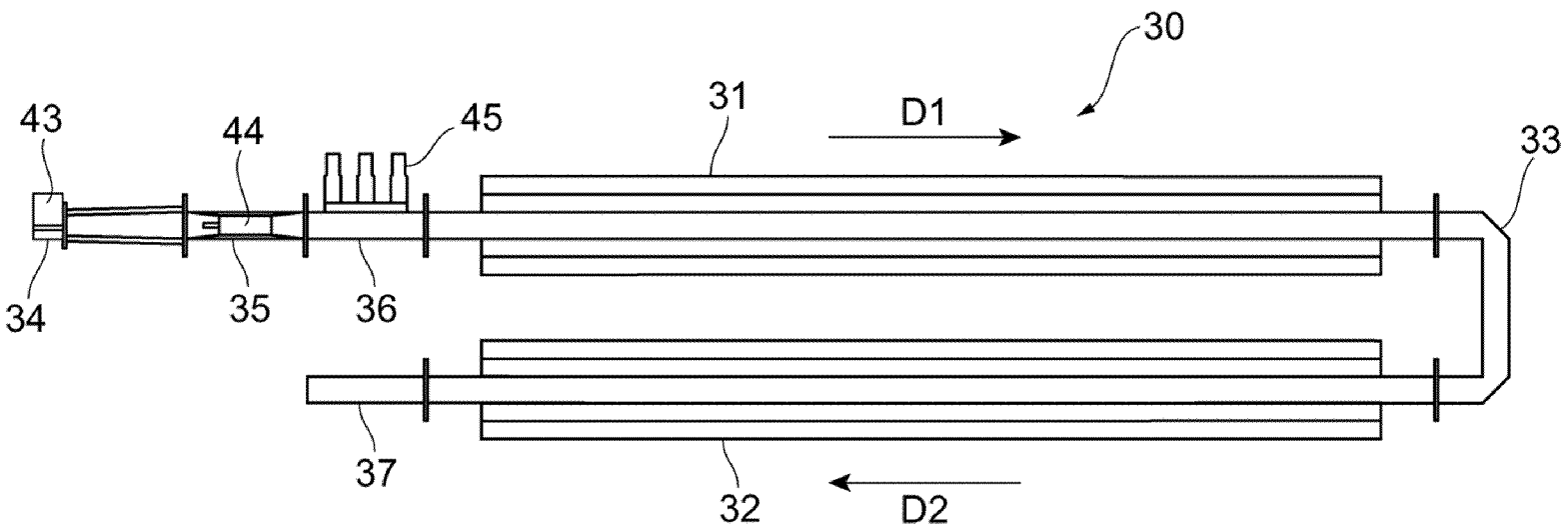
FIG. 4 is a plan view of the wave guide.

FIG. 3 is a perspective view of a wave guide and FIG. 4 is a plan view of the wave guide. As shown in FIG. 3 and FIG. 4, the wave guide 30 is a long wave guide of which section is rectangular and which is bent at its middle portion into a U-like shape so as to have a two-stage structure. The wave guide 30 includes wave guide main bodies 31, 32, a curve section 33, an electromagnetic wave supplying section 34, a propagation preventing section 35, a matching section 36, and a termination section 37. Each of the wave guide main bodies 31, 32, the curve section 33, the electromagnetic wave supplying section 34, the propagation preventing section 35, and the termination section 37 has flanges formed at end surfaces thereof. By superposing and connecting these flanges, the electromagnetic wave supplying section 34 and the propagation preventing section 35, the propagation preventing section 35 and the matching section 36, the matching section 36 and the wave guide main body 31, the wave guide main body 31 and the curve section 33, the curve section 33 and the wave guide main body 32, and the wave guide main body 32 and the termination section 37 are connected, respectively.

The wave guide main bodies 31, 32 are formed to have a long shape to dry ink deposited on the medium M by means of microwaves. Therefore, the wave guide main bodies 31, 32 have insert slits 41, 42 formed therein, respectively, for allowing the medium M, having ink ejected from the inkjet head 23, to pass through the wave guide main bodies 31, 32.

The curve section 33 is formed in a U-like shape and is disposed between the wave guide main body 31 and the wave guide main body 32 to connect the wave guide main body 31 and the wave guide main body 32 in a two-stage structure.

The electromagnetic wave supplying section 34 is disposed at a start end of the wave guide 30 and has a magnetron 43 mounted thereon for generating microwaves. The magnetron 43 generates microwaves to supply the microwaves into the wave guide 30 and guides the microwaves to pass in the forward directions D1, D2 inside the wave guide 30. In the following description, the wave length of the microwaves supplied into the wave guide 30 from the magnetron 43 is λ.

The propagation preventing section 35 is disposed between the wave guide main body 31 and the electromagnetic wave supplying section 34 and has an isolator 44 mounted thereon for propagating the microwaves in only one direction. The isolator 44 is composed of a well-known isolator and allows the propagation of microwaves from the electromagnetic wave supplying section 34 to the wave guide main body 31 and prevents the propagation of microwaves from the wave guide main body 31 to the electromagnetic wave supplying section 34.

The matching section 36 is disposed between the propagation preventing section 35 and the wave guide main body 31 and has a microwave matching box 45 mounted thereon. The microwave matching box 45 is composed of a well-known microwave matching box and is used for improving the absorbance efficiency of microwaves relative to the ink deposited on the medium M by reducing the reflected power of the microwaves supplied from the magnetron 43 by means of impedance matching in the matching section 36.

The termination section 37 is disposed at the terminal end of the wave guide main body 32, that is, at the terminal end of the wave guide 30 and is used to conduct termination process of the microwaves supplied into the wave guide 30.

Figure 5:
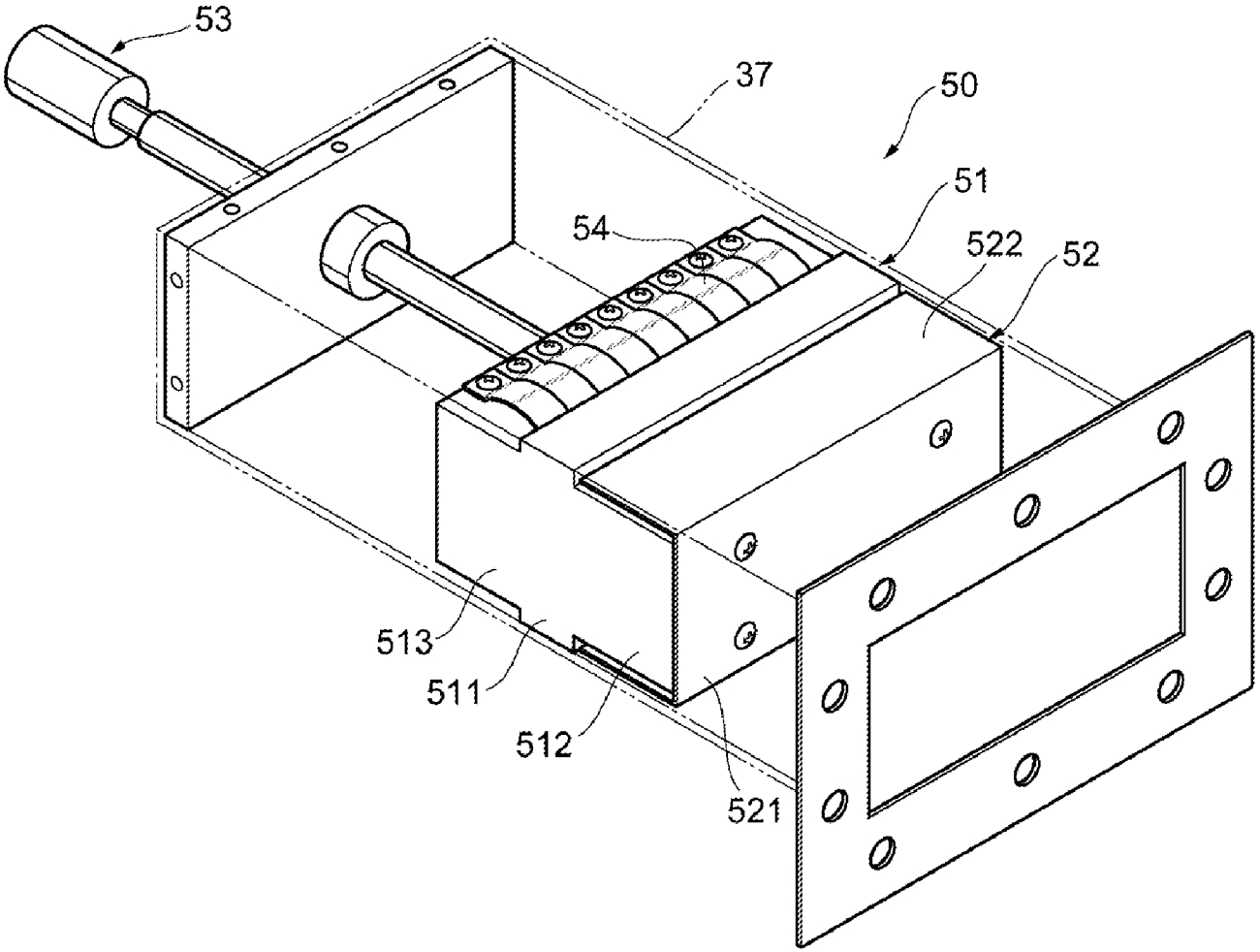
FIG. 5 is a perspective view of a termination section.
Figure 6:
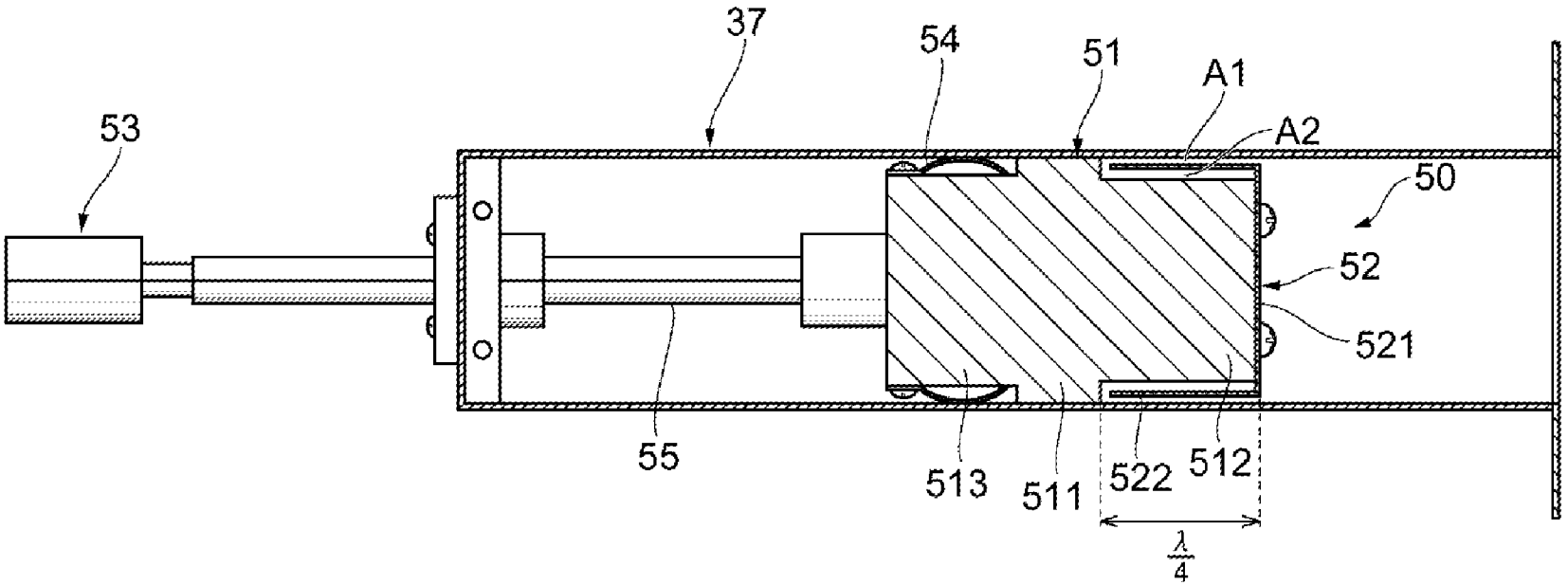
FIG. 6 is a sectional view of the termination section.

FIG. 5 is a perspective view of the termination section and FIG. 6 is a sectional view of the termination section. As shown in FIG. 5 and FIG. 6, the termination section 37 is provided with a reflection termination member 50. The reflection termination member 50 is slidably disposed in the termination section 37 to reflect and terminate the microwaves supplied into the wave guide 30 from the electromagnetic wave supplying section 34. Therefore, the reflection termination member 50 includes a reflection termination body 51, a reflective plate 52, and a slide driving device 53.

The reflection termination body 51 is composed of a conductor and is in contact with the inner wall of the termination section 37 of the wave guide 30 to retain the reflective plate 52. The reflection termination body 51 includes a contact portion 511 all around of which is in contact with the inner wall of the termination section 37, a front projecting portion 512 which projects from the contact portion 511 toward the wave guide main body 32 (the electromagnetic wave supplying section 34) (to the right in FIG. 6) to retain the reflective plate 52, and a rear projecting portion 513 which projects from the contact portion 511 toward the terminal end of the wave guide 30 (to the left in FIG. 6) and is connected to the slide driving device 53.

The contact portion 511 is formed in a rectangular shape in section which is equal to or slightly smaller than the inner wall of the termination section 37 and is slidably retained by the termination section 37.

The front projecting portion 512 has a length about λ/4. The front projecting portion 512 is formed in a rectangular shape in section such that a pair of opposite surfaces are recessed relative to the contact portion 511. Another pair of opposite surfaces which are not recessed are in contact with the inner wall of the termination section 37 so that spaces of λ/4 in length are formed between the recessed opposite surfaces and the inner wall of the termination section 37.

The reflective plate 52 is attached to the end facing the wave body main body 32 (the right-side end in FIG. 6) by screws. The reflective plate 52 is formed in a U-like shape in section and includes a pair of opposite rectangular side portions 522, and a rectangular reflective surface portion 521 connecting the side portions 522. The reflective surface portion 521 is attached to the end of the front projecting portion 512 by screws, whereby the side portions 522 are inserted into the spaces between said front projecting portion 512 and the termination section 37.

The reflective surface portion 521 reflects the microwaves delivered to the termination section 37 to deliver the microwaves in the directions opposite to the forward directions D1, D2 inside the wave guide 30. The reflective surface portion 521 is formed in a shape capable of suitably reflecting microwaves, preferably a plane shape perpendicular to the delivering direction (the forward direction D2) of the microwaves or a curved shape to be convex or concave relative to the delivering direction (the forward direction D2) of the microwaves.

Each side portion 522 is formed to have a length of λ/4 and is arranged to be spaced apart from the inner wall of the termination section 37 and the front projecting portion 512. Therefore, a first space A1 of λ/4 in length is formed between the termination section 37 and the side portion 522 and a second space A2 of λ/4 in length is formed between the side portion 522 and the front projecting portion 512, respectively. At the ends of the respective spaces, the first space A1 and the second space A2 communicate with each other.

It is preferable that the reflective plate 52 is made of a metal, especially, SUS (stainless steel), aluminum, or steel plate. Since the reflective plate 52 is made of a metal, the reflective plate 52 is capable of effectively reflecting the microwaves supplied into the wave guide 30.

The rear projecting portion 513 is formed in a rectangular shape in section such that a pair of opposite surfaces are recessed relative to the contact portion 511. Another pair of opposite surfaces which are not recessed are in contact with the inner wall of the termination section 37 so that spaces are formed between the recessed opposite surfaces and the inner wall of the termination section 37. Leaf springs 54 made of metal are attached to the recessed opposite surfaces of the rear projecting portion 513 by screws so that the leaf spring 54 are in elastic contact with the inner wall of the termination section 37. In addition, a rod 55 connected to the slide driving device 53 is attached to the end surface of the rear projecting portion 513 on the terminal end side (the left-side in FIG. 6).

The slide driving device 53 drives the reflection termination member 50 to slide in the longitudinal direction of the wave guide 30 by the rod 55. In the slide driving device 53, a rotation driving source such as a motor is built-in. The output shaft of the slide driving device 53 is connected to the rod 55 via a gear or a plurality of gears (not shown) for converting the rotation output of the rotation driving source into sliding force in the longitudinal direction of the wave guide 30. By sliding the rod 55 in the longitudinal direction of the wave guide 30 within a range of λ/2 in length, the reflection termination member 50 is driven to slide in the longitudinal direction of the wave guide 30 within the range of λ/2 in length. The sliding control of the reflection termination member 50 is conducted by using any suitable method. For example, the reflection termination member 50 may be always driven to slide at a predetermined speed and may be driven to slide in a stepwise manner at a predetermined interval.

Hereinafter, the actions of the inkjet printer 1 according to this embodiment will be described.

First, the medium M is fed to the place on the platen 22 by rotating the feeding rollers 21. Then, ink is ejected from the inkjet head 23 to the medium M put on the platen 22, thereby printing an image or the like on the medium M.

After that, the medium M with the ink deposited thereon is inserted into the wave guide main body 31 through the insert slit 41, the medium M after the wave guide main body 31 is inserted into the wave guide main body 32 through the insert slit 42, and microwaves are supplied from the magnetron 43 into the wave guide 30.

As for the microwaves supplied into the wave guide 30, for example, microwaves having irradiation energy of 500 W are radiated to the medium M when the feeding speed of the medium M by the feeding rollers 21 is 12 cm/minute and the radiation width of the microwaves in the wave guide main body 31 and the wave guide main body 32 is 12 cm (6 cm×2). Accordingly, the medium M is irradiated with microwaves of 500 W×60 seconds=30000 J.

Then, the microwaves to be supplied from the magnetron 43 into the wave guide 30 are delivered to the wave guide 31 after the reflected power is reduced by the microwave matching box 45 in the matching section 36. Some of microwaves delivered into the wave guide main body 31 are absorbed into the ink deposited on the medium M inserted through the insert slit 41 so as to dry the ink. Some of the microwaves not used to dry ink in the wave guide main body 31 pass through the wave guide main body 31 and are bent in the curve section 33, and are then delivered to the wave guide body 32. Similarly to the case inside the wave guide main body 31, some of the microwaves delivered to the wave guide main body 32 are absorbed into the ink deposited on the medium M inserted through the insert slit 42 so as to dry the ink. After that, some of the microwaves not used to dry ink even in the wave guide main body 32 pass the wave guide main body 32 and are delivered to the termination section 37 where the microwaves are processed by reflection termination treatment member 50.

Now, the reflection termination treatment of microwaves by the reflection termination member 50 will be described in detail.

Most of microwaves delivered to the termination section 37 are reflected at the reflective surface portion 521 of the reflection plate 52 and are thus returned to the wave guide main body 32. Therefore, in the wave guide 30, standing waves are generated by microwaves heading to the termination section 37 from the electromagnetic wave supplying section 34 and microwaves heading to the electromagnetic wave supplying section 34 from the termination section 37. During this, the slide driving device 53 is activated so that the reflection termination member 50 is reciprocated within the range of λ/2 in length in the longitudinal direction of the wave guide 30. Accordingly, the standing waves generated within the wave guide 30 can be varied in the longitudinal direction of the wave guide 30. Therefore, the power of microwaves are dispersed within the wave guide 30, thereby preventing uneven drying of the ink deposited on the medium M passed through the wave guide 30.

In addition, the slide driving device 53 slides the reflection termination member 50 within the range of λ/2 in length, thereby enabling energy peaks of standing waves of the microwaves to spread over the entire range of the wave guide 30. Therefore, uneven drying of the ink deposited on the medium M passed through the wave guide 30 is further prevented. If the terminal end of the wave guide is shorted, the energy peaks of standing waves are generated at intervals of λ/2. The reflection termination member 50 is moved in the range of λ/2 so that the positions of the energy peaks of the standing waves are also moved in the range of λ/2 in the wave guide according to the movement of the reflection termination member 50. Therefore, the energy levels of microwaves at any positions of the wave guide are averaged and are thus equalized, thereby further preventing uneven drying of the ink deposited on the medium M passed through the wave guide 30.

On the other hand, some of microwaves delivered to the termination section 37 are not reflected at the reflective surface portion 521 and enter into the first space A1 formed between the inner wall of the termination section 37 and the side portion 522 of the reflective plate 52. Then, the microwaves enter into the second space A2 formed between the side portion 522 of the reflective plate 52 and the front projecting portion 512. The first space A1 and the second space A2 are connected to each other along the length of λ/4. Since the end of the second space A2 is shunted to the reflective surface portion 521, the impedance becomes the maximum and the current becomes zero at the connected portion between the first space A1 and the second space A2. The contact area between the contact portion 511 and the inner surface of the termination section 37 may be made of a resin or ceramic having good slidablity, not a metal, thereby preventing electric waves (microwaves) from leaking outside.

At the entrance of the first space A1, the impedance becomes zero. Accordingly, the entrance of the first space A1 is apparent non-existent as viewed from the wave guide, thereby minimizing the energy of radio waves leaking through these spaces.

The microwaves processed by the reflection termination treatment at the termination section 37 are returned from the termination section 37 to the wave guide main body 32. Some of the microwaves delivered to the wave guide main body 32 are absorbed into the ink deposited on the medium M inserted through the insert slit 42 so as to dry the ink. Some of the microwaves not used to dry ink in the wave guide main body 32 pass through the wave guide main body 32 and are bent in the curve section 33, and are then delivered to the wave guide body 31. Some of the microwaves delivered to the wave guide main body 31 are absorbed into the ink deposited on the medium M inserted through the insert slit 41 so as to dry the ink. After that, some of microwaves not used to dry ink even in the wave guide main body 31 pass through the wave guide main body 31 and are delivered to the propagation preventing section 35. The microwaves delivered to the propagation preventing section 35 are prevented from being propagated to the electromagnetic wave supplying section 34 by the isolator 44 attached to the propagation preventing section 35.

According to the inkjet printer 1 of this embodiment, ink is ejected by the inkjet head 23 and is thus deposited on the medium M and the medium M is inserted into the wave guide 30 to which microwaves are supplied by the magnetron 43. By the microwaves, the ink deposited on the medium M is dried. Since the microwaves supplied by the magnetron 43 are reflected by the reflection termination member 50 in the termination section 37 after the propagation through the wave guide 30, the microwaves reflected are again used to dry the ink deposited on the medium M. In the wave guide 30, the ink deposited on the medium M is dried by the microwaves reflected by the reflection termination member 50 in addition to the microwaves supplied directly from the magnetron 43, thereby rapidly drying the ink.

Also according to the inkjet printer 1, the microwaves supplied into the wave guide 30 from the magnetron 43 are reflected by the reflection termination member 50. However, since the propagation preventing section 35 with the isolator 44 attached thereto is disposed between the wave guide main body 31 and the electromagnetic wave supplying section 34, the reflected microwaves are prevented from being propagated to the magnetron 43. Therefore, the magnetron 43 is prevented from being broken by the reflected microwaves.

Second Embodiment

Figure 7:
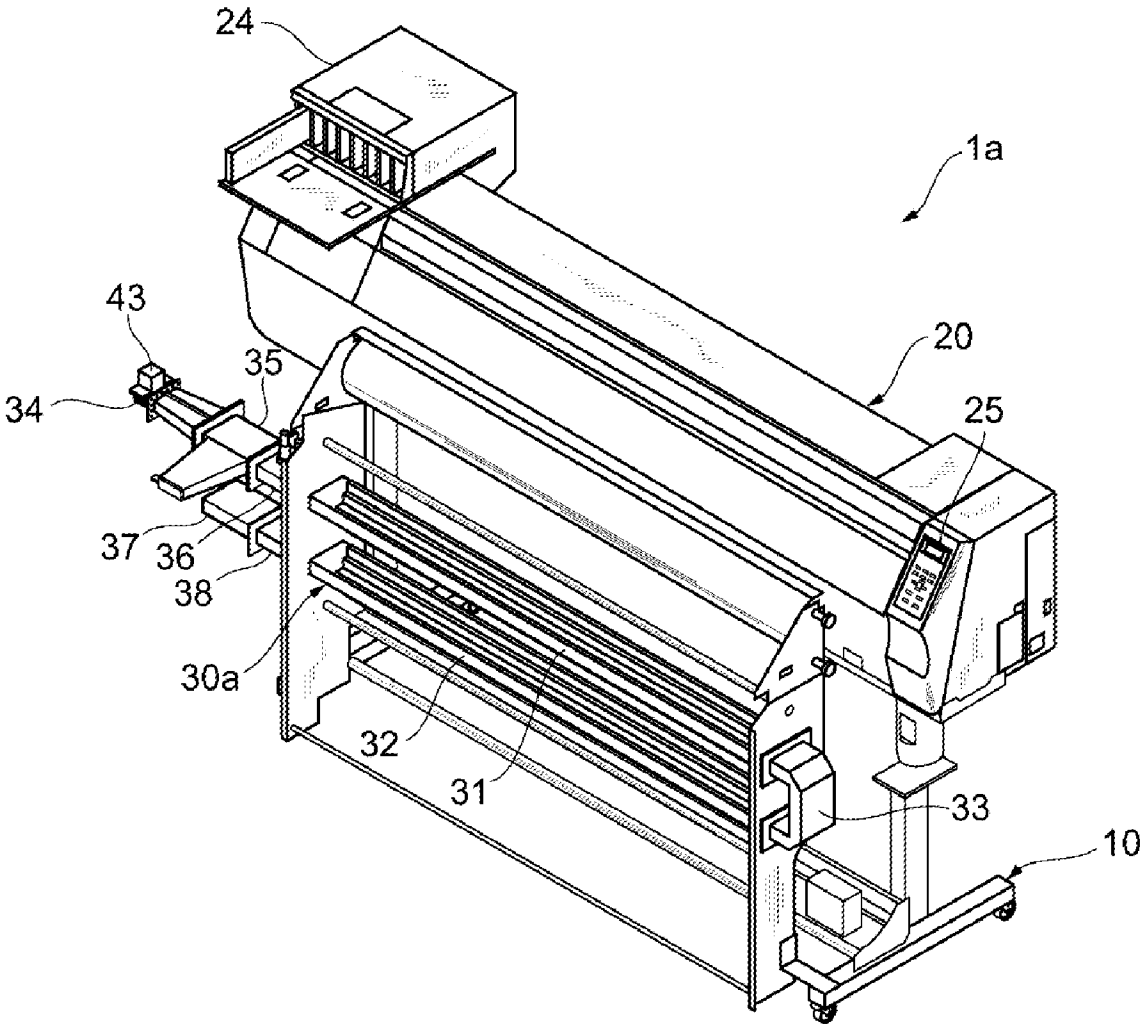
FIG. 7 is a perspective view of an inkjet printer according to a second embodiment.

Hereinafter, the second embodiment will be described in detail. FIG. 7 is a perspective view of an inkjet printer according to this embodiment.

As shown in FIG. 7, the inkjet printer la according to the second embodiment includes a printer section 20 which is mounted on a base 10 to eject ink onto a medium M and a wave guide 30*a* for drying the ink deposited on the medium M by the printer section 20.

Figure 8:
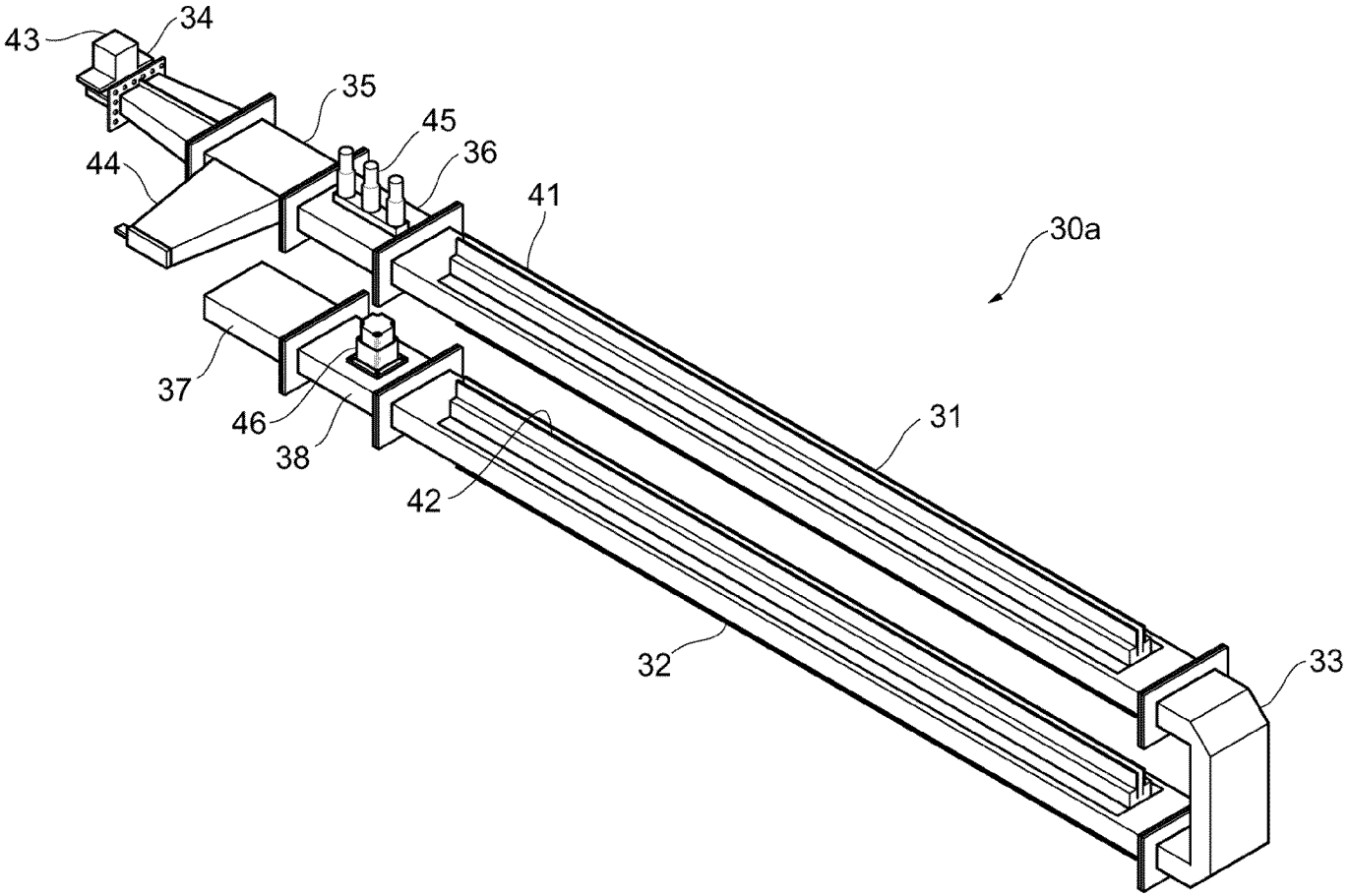
FIG. 8 is a perspective view of a wave guide.
Figure 9:
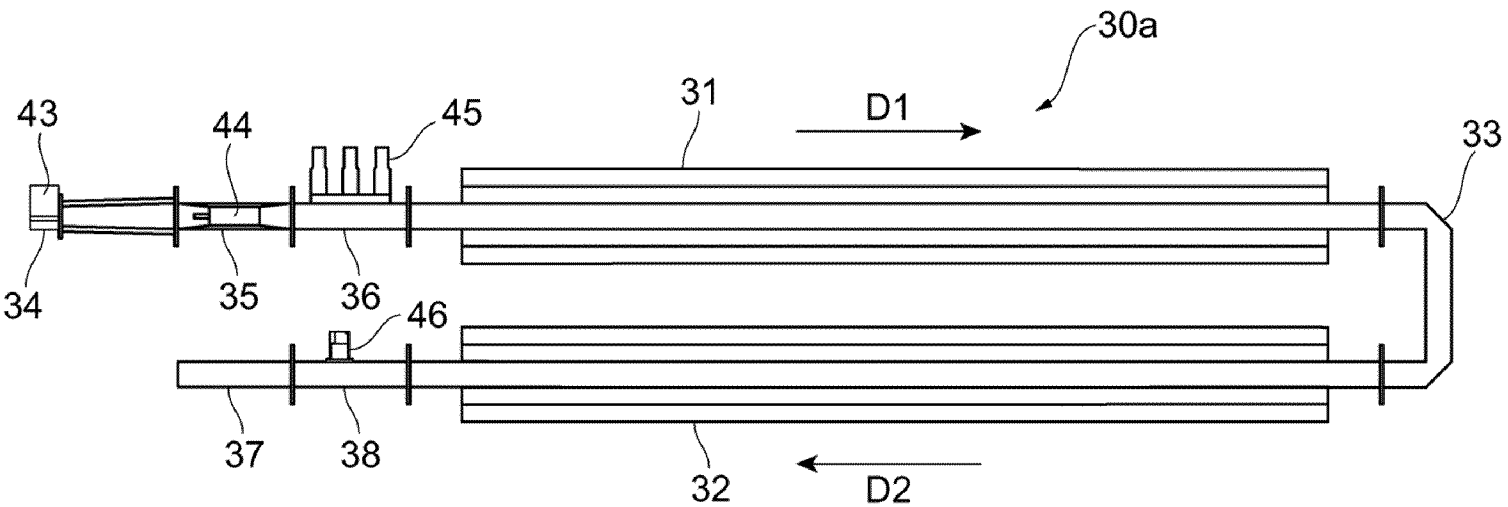
FIG. 9 is a plan view of the wave guide.

FIG. 8 is a perspective view of the wave guide and FIG. 9 is a plan view of the wave guide. As shown in FIG. 8 and FIG. 9, the wave guide 30*a* is a long wave guide of which section is rectangular and which is bent at its middle portion into a U-like shape so as to have a two-stage structure. The wave guide 30*a* includes wave guide main bodies 31, 32, a curve section 33, an electromagnetic wave supplying section 34, a propagation preventing section 35, a matching section 36, a termination section 37, and a rotary reflection section 38. That is, the wave guide 30*a* is formed by adding the rotary reflection section 38 to the wave guide 30 of the inkjet printer 1 according to the first embodiment.

The rotary reflection section 38 is disposed between the wave guide main body 32 and the termination section 37 at the terminal end of the wave guide main body 32. Similarly to the wave guide main bodies 31, 32, the curve section 33, the electromagnetic wave supplying section 34, the propagation preventing section 35, and the termination section 37, the rotary reflection section 38 also has flanges formed at end surfaces thereof. By superposing and connecting these flanges, the electromagnetic wave supplying section 34 and the propagation preventing section 35, the propagation preventing section 35 and the matching section 36, the matching section 36 and the wave guide main body 31, the wave guide main body 31 and the curve section 33, the curve section 33 and the wave guide main body 32, the wave guide main body 32 and the rotary reflection section 38, and the rotary reflection section 38 and the termination section 37 are connected, respectively.

Figure 10:
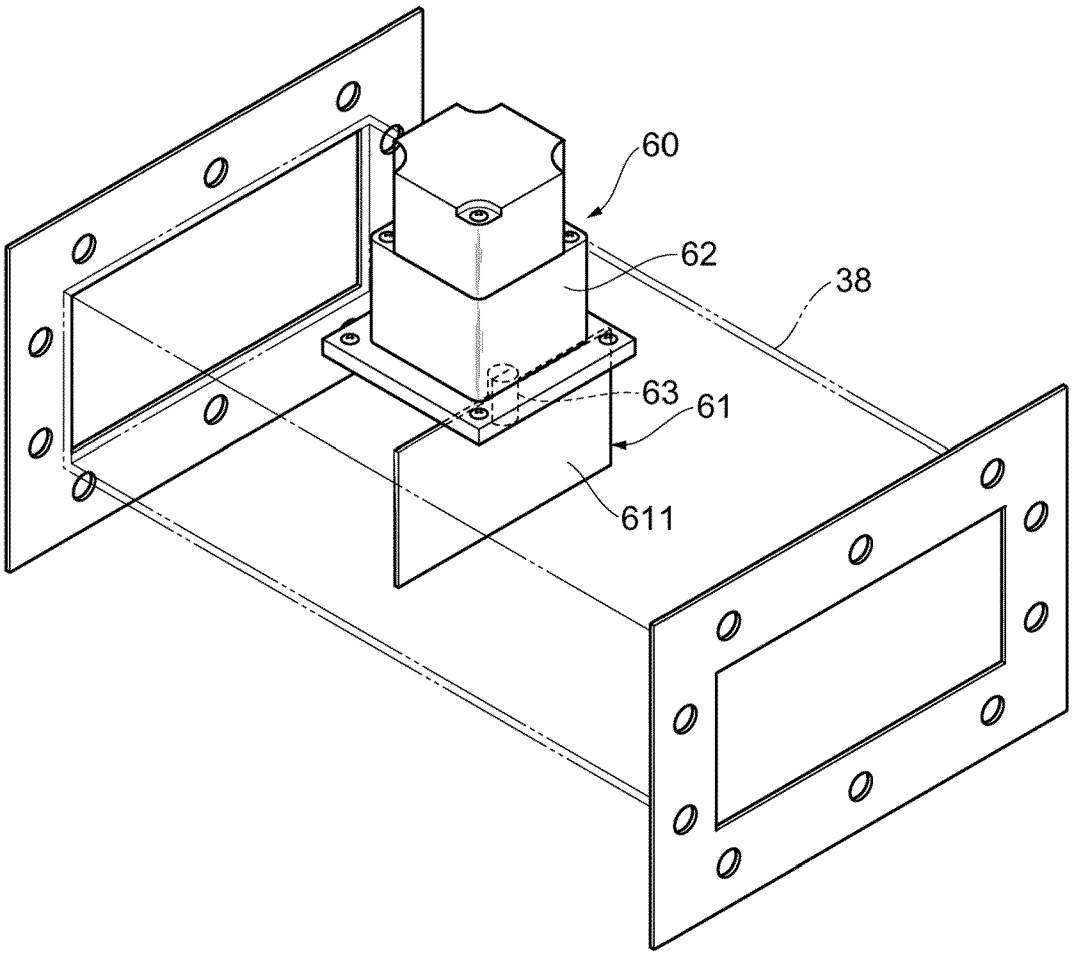
FIG. 10 is a perspective view of a rotary reflection section.
Figure 11:
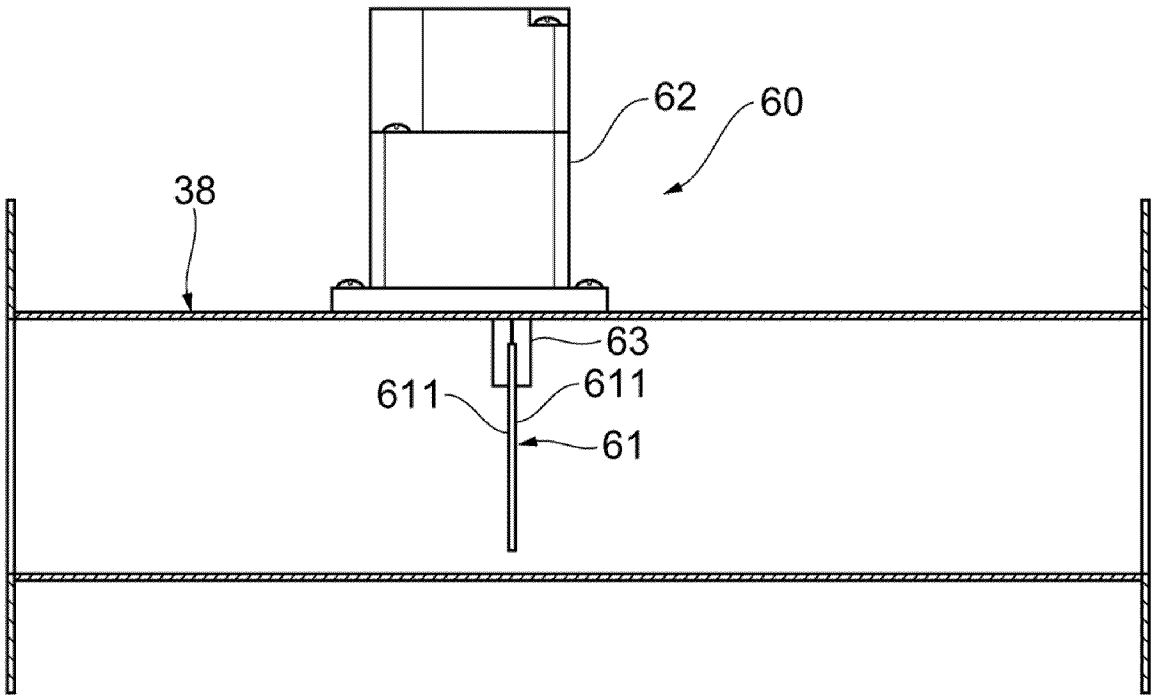
FIG. 11 is a vertical sectional view of the rotary reflection section.

FIG. 10 is a perspective view of the rotary reflection section and FIG. 11 is a vertical sectional view of the rotary reflection section. As shown in FIG. 10 and FIG. 11, the rotary reflection section 38 is provided with a propeller mechanism 60. The propeller mechanism 60 reflects microwaves supplied from the magnetron 43 and fluctuates standing waves generated in the wave guide 30*a* to disturb the standing waves. For this, the propeller mechanism 60 is composed of a propeller 61 and a motor 62 for rotating the propeller 61 and reflects microwaves delivered to the rotary reflection section 38 with rotating the propeller 61.

The propeller 61 is disposed within the rotary reflection section 38 to have a predetermined distance from the inner wall of the rotary reflection section 38 and is formed in a plate shape substantially the same as the shape of the internal section of the rotary reflection section 38. The propeller 61 has reflecting surfaces 611 for reflecting microwaves which are formed on the front and rear surfaces thereof. Each reflecting surface 611 is formed into a shape suitably reflecting microwaves, i.e. a plane shape or a convexed or concaved surface shape.

It is preferable that the propeller 61 is made of a metal, especially, SUS (stainless steel), aluminum, or steel plate. Since the propeller 61 is made of a metal, the propeller 61 is capable of effectively reflecting the microwaves supplied into the wave guide 30*a*.

The motor 62 is placed on the top (the upper surface in FIG. 9) of the rotary reflection section 38. The motor 62 has a rotation output shaft 63 which extends in a direction perpendicular to the delivering direction D2 of the microwaves and is connected to the propeller 61. By the rotation driving of the motor 62, the propeller 61 is rotated about the shaft perpendicular to the delivering direction D2 of the microwaves within the rotary reflection section 38. It is preferable that the rotation output shaft 63 is made of a nonconductive material such as ceramic, not a metal. When the rotation output shaft 63 is connected to the motor after passing through the wall of the wave guide, leakage of radio waves (leakage of microwaves) from the portion of the wave guide through which the rotation output shaft passes is reduced because of the nonconductive material.

Figure 12:
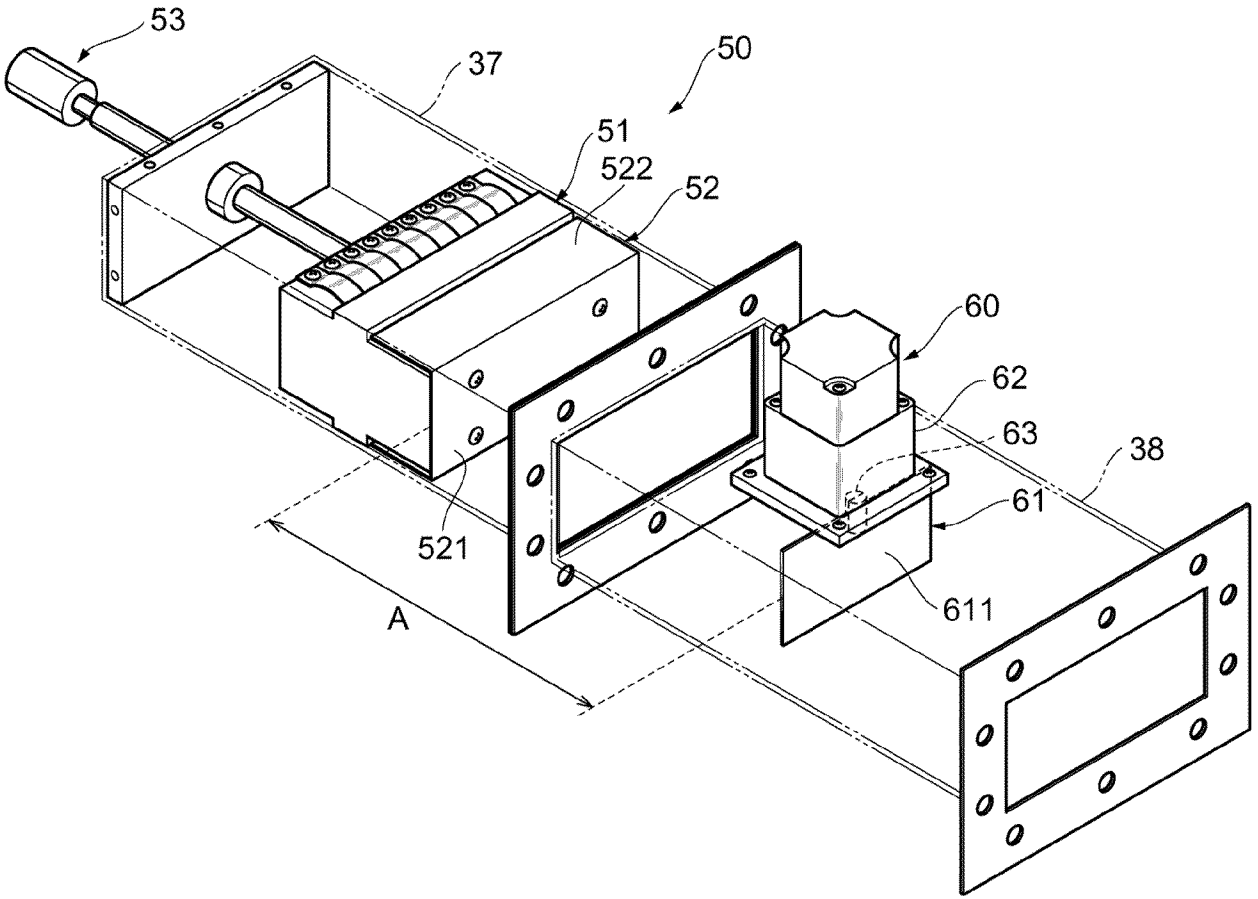
FIG. 12 is a perspective view showing a state that a termination section and the rotary reflection section are connected.

FIG. 12 is a perspective view showing a state that the termination section and the rotary reflection section are connected. As shown in FIG. 12, the termination section 37 and the rotary reflection section 38 are connected so that the reflection termination member 50 is disposed on the termination end side of the wave guide 30*a* relative to the propeller mechanism 60 and the propeller mechanism 60 is disposed on the start end side of the wave guide 30*a* relative to the reflection termination member 50. By controlling the operation of the slide driving device 53, the distance A between the reflective plate 52 and the propeller 61 is set. Specifically, the slide position of the reflection termination member 50 is set such that the distance A between the reflecting surface of the reflective surface portion 521 and the central axis of the rotation output shaft 63 becomes $(n/2)\cdot\lambda g$. Here, "$\lambda g$" is a wave length of microwaves supplied from the magnetron 43 to the wave guide 30*a* and "n" is an integer number equal to or more than 1 ("n" is preferably 2 or more in the light of mechanical interference of the propeller 61 and the like).

Hereinafter, the actions of the inkjet printer 1*a* according to this embodiment will be described.

First, the medium M is fed to the place on the platen 22 by rotating the feeding rollers 21. Then, ink is ejected from the inkjet head 23 to the medium M put on the platen 22, thereby printing an image or the like on the medium M.

After that, the medium M with the ink deposited thereon is inserted into the wave guide main body 31 through the insert slit 41, the medium M after the wave guide main body 31 is inserted into the wave guide main body 32 through the insert slit 42, and microwaves are supplied from the magnetron 43 into the wave guide 30*a*.

As for the microwaves supplied into the wave guide 30*a*, for example, microwaves having irradiation energy of 500 W are radiated to the medium M when the feeding speed of the medium M by the feeding rollers 21 is 12 cm/minute and the radiation width of the microwaves in the wave guide main body 31 and the wave guide main body 32 is 12 cm (6 cm×2). Accordingly, the medium M is irradiated with microwaves of 500 W×60 seconds=30000 J.

Then, the microwaves to be supplied from the magnetron 43 into the wave guide 30*a* are delivered to the wave guide 31 after the reflected power is reduced by the microwave matching box 45 in the matching section 36. Some of microwaves delivered into the wave guide main body 31 are absorbed into the ink deposited on the medium M inserted through the insert slit 41 so as to dry the ink. Some of the microwaves not used to dry ink in the wave guide main body 31 pass through the wave guide main body 31 and are bent in the curve section 33, and are then delivered to the wave guide body 32. Similarly to the case inside the wave guide main body 31, some of the microwaves delivered to the wave guide main body 32 are absorbed into the ink deposited on the medium M inserted through the insert slit 42 so as to dry the ink.

After that, some of the microwaves not used to dry ink even in the wave guide main body 32 pass the wave guide main body 32 and are delivered to the rotary reflection section 38. The microwaves delivered to the rotary reflection section 38 are processed by the reflection treatment by the propeller 61 of the propeller mechanism 60. The microwaves passing through the rotary reflection section 38 are delivered to the termination section 37 where the microwaves are processed by the reflection termination treatment by the reflective plate 52 of the reflection termination member 50.

Now, the reflection termination treatment of microwaves by the reflection termination member 50 and the reflection treatment of microwaves by the propeller mechanism 60 will be described in detail.

The propeller 61 is rotated within the rotary reflection section 38 by actuating and rotating the motor 62 of the propeller mechanism 60 while microwaves are supplied from the magnetron 43. Accordingly, some of the microwaves delivered to the rotary reflection section 38 are reflected by the reflecting surface 611 of the propeller 61. Since the propeller 61 is rotated by the actuation of the motor 62, the microwaves are reflected in the direction to which the reflecting surface 611 faces and which is arbitrarily changed according to the rotation angle of the propeller 61.

Figure 13:
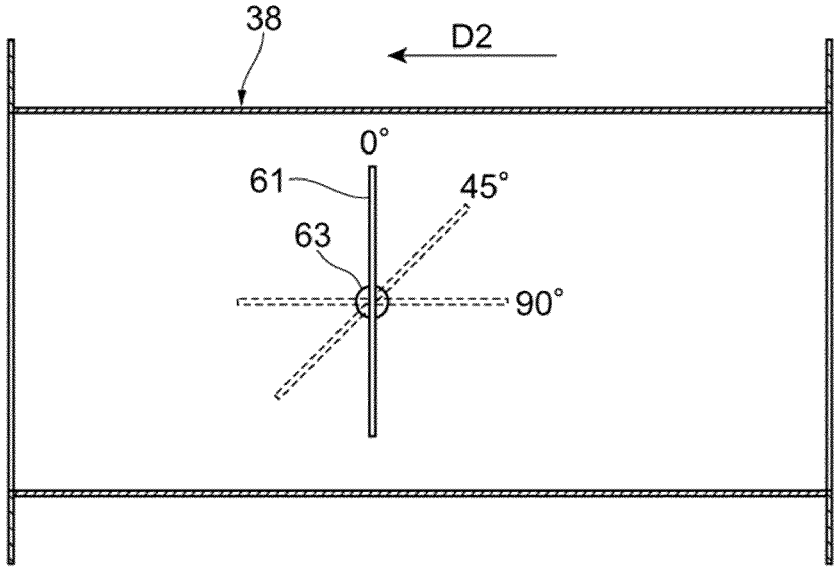
FIG. 13 is an illustration showing rotation angles of a propeller in the rotary reflection section.
Figure 14A:
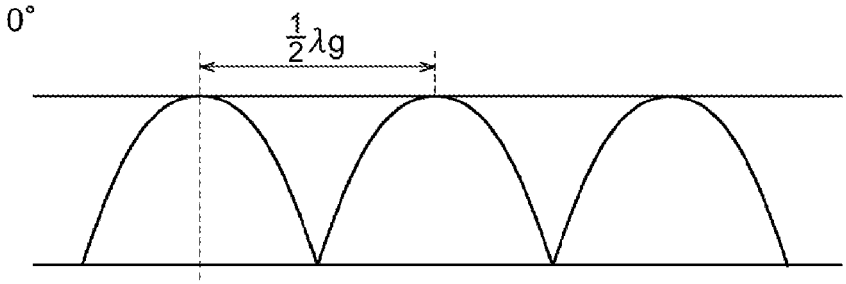
FIGS. 14A-14C are illustrations showing standing wave patterns at the rotation angles of the propeller shown in FIG. 13, respectively.
Figure 14B:
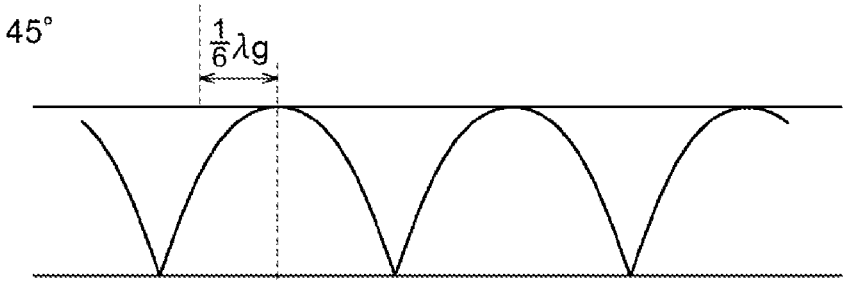
Figure 14C:
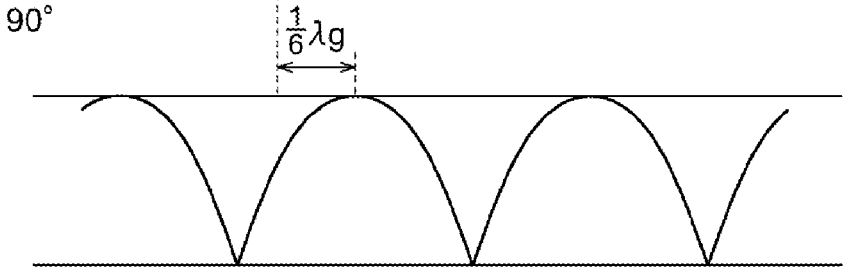

FIG. 13 is an illustration showing rotation angles of the propeller in the rotary reflection section and FIGS. 14A-14C are illustrations showing standing wave patterns at the rotation angles of the propeller shown in FIG. 13, respectively. In this embodiment, the rotation angle of the propeller 61 that the propeller 61 faces a direction perpendicular to the delivering direction D2 of the microwaves is 0° and the rotation angle is greater in the positive direction as the propeller 61 is rotated in the clockwise direction. As shown in FIG. 13 and FIGS. 14A-14C, standing waves shown in FIG. 14A are generated when the rotation angle of the propeller 61 is 0°. When the rotation angle of the propeller 61 is changed to 45°, standing waves shown in FIG. 14B of which phase is shifted by $(1/6)\cdot\lambda g$ relative to the standing waves when the rotation angle of the propeller 61 is 0° are generated. When the rotation angle of the propeller 61 is changed to 90°, standing waves shown in FIG. 14C of which phase is shifted by $(1/3)\cdot\lambda g$ relative to the standing waves when the rotation angle of the propeller 61 is 0°, i.e. of which phase is shifted by $(1/6)\cdot\lambda g$ relative to the standing waves when the rotation angle of the propeller 61 is 45° are generated.

By the rotation of the propeller 61, the reflection direction of the microwaves reflected by the propeller 61 is changed, thereby restraining the generation of standing waves which are generated by the microwaves from the electromagnetic wave supplying section 34 to the rotary reflection section 38 and the microwaves reflected by the propeller 61 and varying the peak positions of the standing waves within the wave guide 30*a*.

On the other hand, microwaves which are not reflected by the propeller 61 and are delivered to the termination section 37 are reflected by the reflective surface portion 521 of the reflective plate 52 and are thus returned to the wave guide main body 32. Since the reflection termination member 50 and the magnetron 43 are fixed, standing waves are generated within the wave guide 30*a* by microwaves proceeding from the electromagnetic wave supplying section 34 to the termination section 37 and microwaves proceeding from the termination section 37 to the electromagnetic wave supplying section 34. However, some of microwaves supplied into the wave guide 30*a* are reflected by the propeller 61 and are thus not delivered to the termination section 37, thereby reducing the power of standing waves generated by microwaves proceeding from the electromagnetic wave supplying section 34 to the termination section 37 and microwaves proceeding from the termination section 37 to the electromagnetic wave supplying section 34.

Microwaves processed by reflection treatment in the rotary reflection section 38 and microwaves processed by reflection termination treatment in the termination section 37 are returned from the rotary reflection section 38 and the termination section 37 to the wave guide main body 32. Some of microwaves delivered to the wave guide main body 32 are absorbed into the ink deposited on the medium M inserted through the insert slit 42 so as to dry the ink. Some of the microwaves not used to dry ink in the wave guide main body 32 pass through the wave guide main body 32 and are bent in the curve section 33, and are then delivered to the wave guide body 31. Some of the microwaves delivered to the wave guide main body 31 are absorbed into the ink deposited on the medium M inserted through the insert slit 41 so as to dry the ink. After that, some of microwaves not used to dry ink even in the wave guide main body 31 pass through the wave guide main body 31 and are delivered to the propagation preventing section 35. The microwaves delivered to the propagation preventing section 35 are prevented from being propagated to the electromagnetic wave supplying section 34 by the isolator 44 attached to the propagation preventing section 35.

Figures 15A, 15B, 15C, 15D:
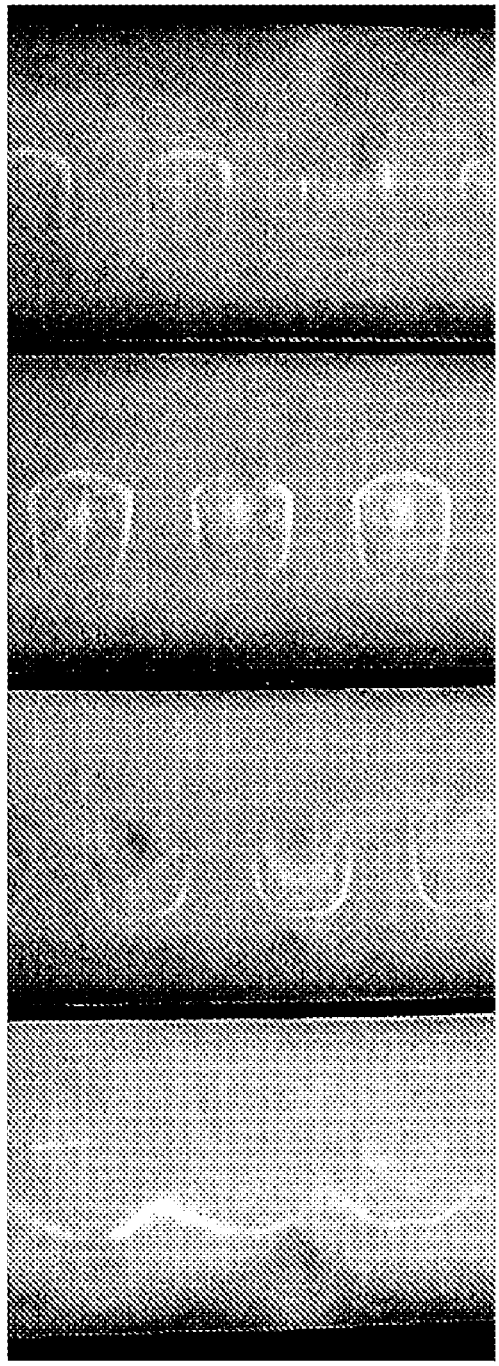
FIGS. 15A-15D are photographs of media in a case where the media are dried with a distance of 220 mm between a rotation output shaft of a propeller mechanism and a reflective plate of a reflection termination member.

Then, examples of the inkjet printer according to the embodiment of the present invention will be described. In the following description, states of drying in case where ink deposited on the medium M is dried by the wave guide 30*a* of the inkjet printer la according to the second embodiment have been experienced. Experiment condition is as follows:

(1) material of the medium M: polyvinyl chloride
(2) output power of the magnetron: 800 W
(3) wave length of microwaves:
147.88 mm inside the wave guide, 122.4 mm in atmosphere (free space)
(wave guide WRI-22, JIS-C6601-6608 according to the standard of Electric Industries Association of Japan (EIAJ))
(4) radiation time of microwaves: two minutes
(5) rotation speed of the propeller: 13 rpm Ink deposited on the medium M was dried in the aforementioned conditions by the inkjet printer la. The states of drying according to the rotation angles of the propeller 61 are shown in FIGS. 15A-15D. FIGS. 15A-15B are photographs of the medium M when dried with a distance of 220 mm between the rotation output shaft of the propeller mechanism and the reflective plate of the reflection termination member, wherein FIG. 15A is a case where the rotation angle of the propeller 61 is fixed to 0°, FIG. 15B is a case where the rotation angle of the propeller 61 is fixed to 45°, FIG. 15C is a case where the rotation angle of the propeller 61 is fixed to 90°, and FIG. 15D is a case where the propeller 61 is rotated. A plurality of substantially circular discolored portions shown in FIGS. 15A-15D are extremely heated portions where are rapidly dried by the peaks of standing waves as compared to the other portions. By observing the extremely heated portions, the peaks of standing waves within the wave guide 30*a* are estimated so that the power at the peaks of standing waves can be estimated.

As shown in FIGS. 15A-15C, when the rotation angle of the propeller 61 is fixed to 0°, 45°, or 90°, a plurality of extremely heated portions appear so that unevenness of drying is shown. The appearing positions of the extremely heated portions differ according to the rotation angle of the propeller 61. It is apparent from FIG. 15D that the appearance of the extremely heated portion is reduced by the rotation of the propeller 61, thereby preventing uneven drying as a whole.

Figure 16:
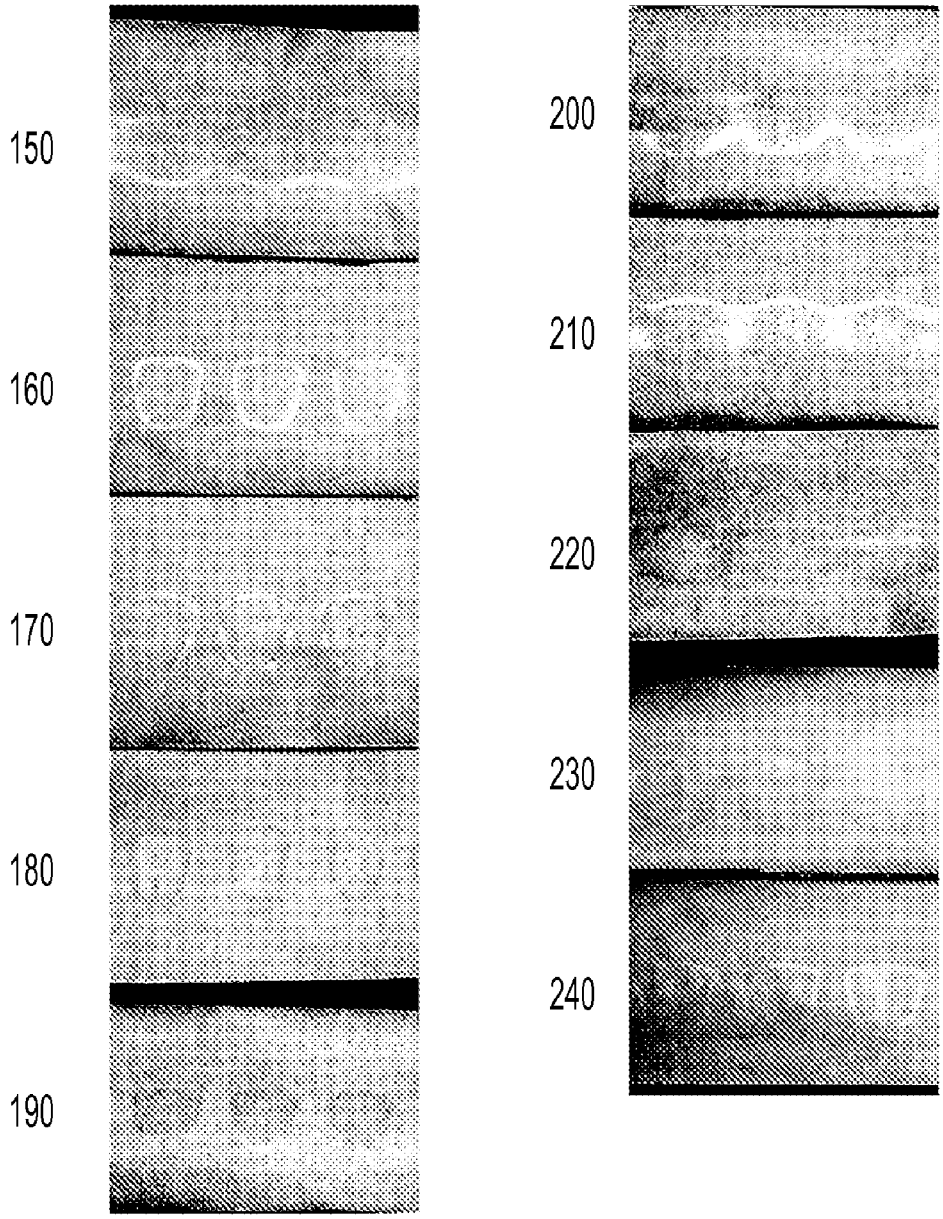
FIG. 16 shows photographs of media in cases where the media are dried with different distances between the rotation output shaft of the propeller mechanism and the reflective plate of the reflection termination member.
Figures 17A, 17B:
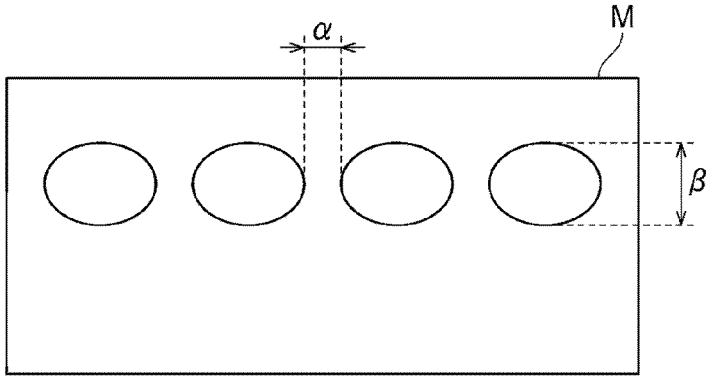
FIGS. 17A-17B show measurement results of uneven drying of the cases shown in FIG. 16.

The states of drying of the ink according to the distance A between the rotation output shaft 63 of the propeller mechanism 60 and the reflective plate 52 of the reflection termination member 50 are shown in FIG. 16 and FIGS. 17A-17B. FIG. 16 shows photographs of the media M after dried and FIGS. 17A-17B show measurement results of unevenness of drying. FIG. 17A shows a distance between the extremely heated portions and a width of the extremely heated portions according to each of the distances shown in FIG. 16 and FIG. 17B is a schematic view of the medium M for explaining the distance between the extremely heated portions and the width of the extremely heated portions.

As shown in FIG. 16, the appearance levels of the extremely heated portions differ according to the distance A between the rotation output shaft 63 and the reflective plate 52. As shown in FIGS. 17A-17B, the distance a between the extremely heated portions and the width β of the extremely heated portions differ according to the distance A between the rotation output shaft 63 and the reflective plate 52.

It is apparent from FIG. 16 and FIGS. 17A-17B that the uneven drying is prevented because the degree of appearance of the extremely heated portions is minimum when the distance A between the rotation output shaft 63 and the reflective plate 52 is $(n/2)\cdot\lambda g$ (n is preferably 2 or more taking the mechanical interference such as of the propeller 61 into consideration), i.e. 150 or 220 mm.

According to the inkjet printer 1*a* of the second embodiment, ink is ejected by the inkjet head 23 and is thus deposited the medium M and the medium M is inserted into the wave guide 30*a* to which microwaves are supplied by the magnetron 43. The microwaves supplied by the magnetron 43 are propagated within the wave guide 30*a* and are then reflected by the propeller 61 in the rotation reflecting portion 38. By the reflected, the ink deposited on the medium M is dried again. Since the direction of the microwaves reflected by the propeller 61 varies by rotation of the propeller 61, standing waves generated by the microwaves supplied by the magnetron 43 and the microwaves reflected by the propeller 61 fluctuate. Accordingly, the positions of peaks of standing waves fluctuate within the wave guide 30*a*, thereby preventing uneven drying of the ink deposited on the medium M.

By the rotation of the propeller 61 about the shaft perpendicular to the delivering direction D2 of the microwaves in the wave guide 30*a*, the microwaves supplied into the wave guide 30*a* are effectively reflected. In addition, the propeller mechanism 60 can be easily attached to the rotary reflection section 38 in the wave guide 30*a*.

Since microwaves not reflected by the propeller 61 are processed by reflection termination treatment of the reflection termination member 50 disposed on the terminal end side of the rotary reflection section 38, microwaves supplied by the magnetron 43 are securely reflected, thereby further rapidly drying the ink deposited on the medium M.

Since the propeller 61 is formed in a plane shape substantially equal to the shape of the internal section of the rotary reflection section 38, the microwaves delivered to the rotary reflection section 38 are effectively reflected.

The distance A between the reflective plate 52 of the reflection termination member 50 and the propeller 61 is $(n/2)\cdot\lambda g$, thereby preventing uneven drying of the ink deposited on the medium M.

In this case, the reflection termination member 50 is slid by the slide driving device 53 to change the distance A between the reflective plate 52 and the propeller 61, thereby changing the positions of peaks of the standing waves generated in the wave guide 30*a*. Accordingly, the power of the microwaves are dispersed inside the wave guide, thereby further preventing uneven drying of the ink deposited on the medium passed through the wave guide.

Though microwaves supplied from the magnetron 43 into the wave guide 30*a* are reflected by the propeller 61, the reflected microwaves are prevented from being propagated to the magnetron 43 because the propagation preventing section 35 with the isolator 44 is disposed between the magnetron 43 and the propeller 61. Therefore, the magnetron 43 is prevented from being broken due to the reflected microwaves.

Since the propeller 61 is made of a metal, it is possible to effectively reflecting the microwaves supplied to the wave guide 30*a*.

Though the embodiments of the present invention have been described in the above, the scope of the present invention is not limited to the aforementioned embodiments. For example, though the wave guide having the two-stage structure is used in any of the aforementioned embodiments, the wave guide may have a one-stage structure or a three-stage structure or more.

Though the reflection termination body 51 and the reflective plate 52 are discrete components as the reflection termination member 50, the reflection termination member 50 may be an integral component and may be composed of a larger number of components. The second space A2 formed in the reflection termination member 50 is formed by cutting the reflection termination body 51 itself. Though the first space A1 and the second space A2 are formed on two surfaces of the wave guide 30 in the aforementioned embodiment, these may be formed on one surface, three surfaces, or four surfaces.

Though the sliding width of the reflection termination member 50 is in a range of λ/2 in any of the aforementioned embodiments, the sliding width may be shorter than λ/2 or longer than λ/2.

Figure 18:
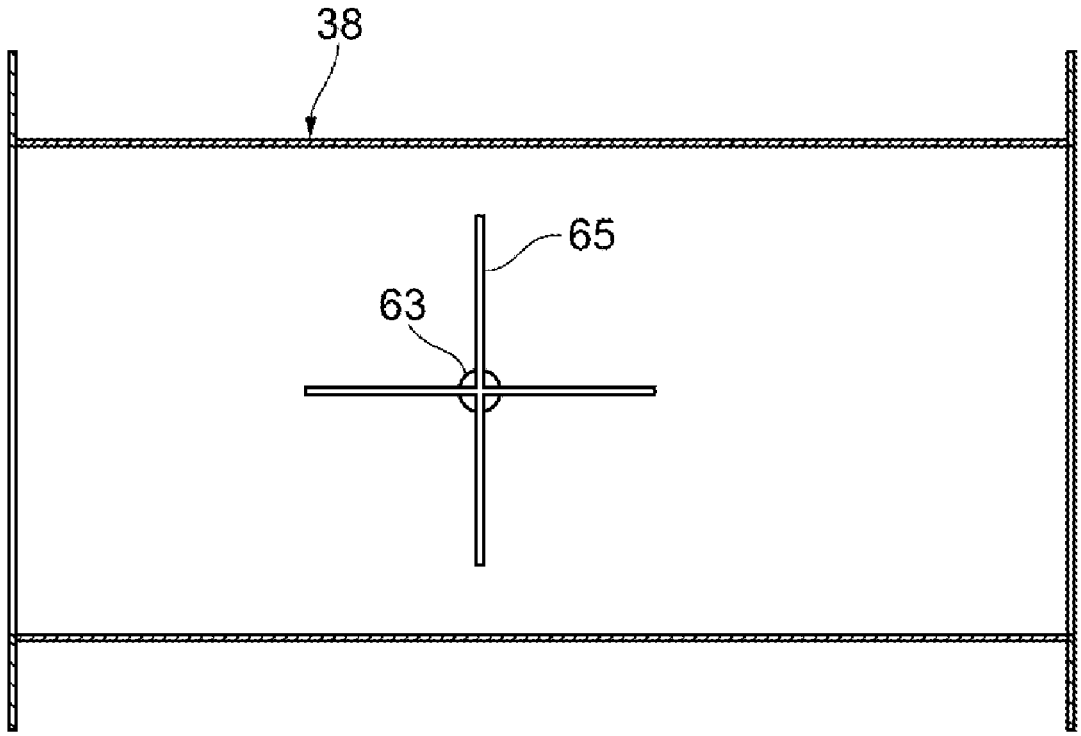
FIG. 18 is a cross sectional view of a rotary reflection section using another propeller.
Figure 19:
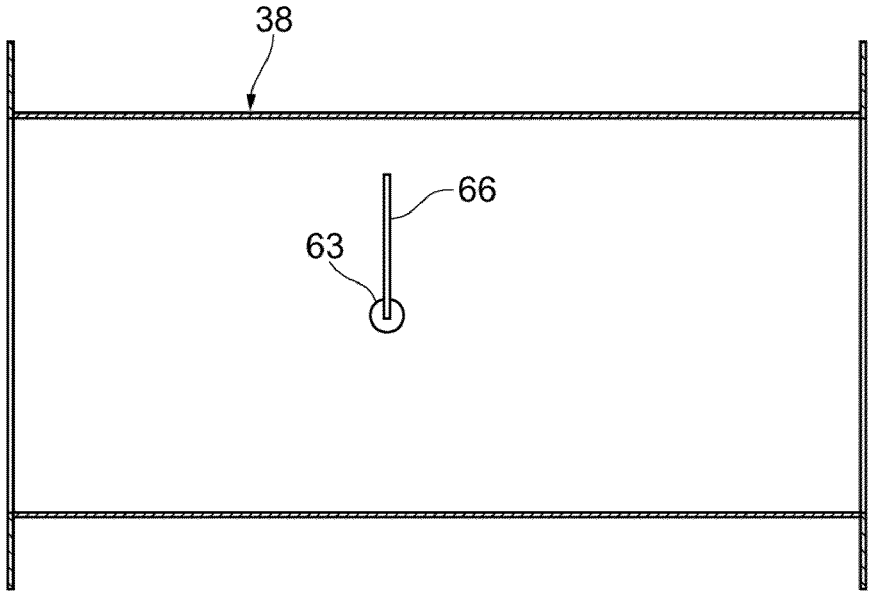
FIG. 19 is a cross sectional view of a rotary reflection section using another propeller.

Though the plate-like propeller 61 having blades extending in two directions opposite to each other from the rotation output shaft 63 as the center axis is used in the aforementioned second embodiment, the shape of the propeller may be any shape capable of rotating in the rotary reflection section 38. For example, as shown in FIG. 18, a propeller 65 having blades extending in four directions from the rotation output shaft 63 as the center axis so that the section of the propeller 65 has a cross shape may be used. As shown in FIG. 19, a plate-like propeller 66 having a blade extending in a single direction from the rotation output shaft 63 as the center axis may be used.

Though the propeller 61 is rotated about the shaft extending in the direction perpendicular to the delivering direction D2 of microwaves in the aforementioned second embodiment, the reflecting surface 611 of the propeller 61 may be rotated in any direction within the rotary reflection section 38.

Though the wave guide 30*a* has the reflection termination member 50 in the aforementioned second embodiment, the wave guide 30*a* does not necessarily have the reflection termination member 50. In this case, for example, the reflection termination member 50 may be provided with a shunting plate or a termination member capable of absorbing microwaves to terminate.

Though the reflection termination member 50 is provided in the aforementioned second embodiment, the reflection termination member 50 is not necessarily provided and the propeller mechanism 60 is attached to the termination section 37. Also in this case, microwaves supplied into the wave guide 30*a* are reflected by the propeller 61, thereby obtaining the same works and effects as mentioned above.

Though the reflection termination member 50 is slidable in any of the aforementioned embodiments, the reflection termination member 50 may be fixed in the wave guide. In this case, a means for sliding the propeller 61 in the longitudinal direction of the wave guide may be provided for the purpose of changing the distance A between the reflection termination member 50 and the propeller 61 in the second embodiment.

According to the inkjet printer of the embodiment of the present invention, after ink is ejected by the ejecting means and is thus deposited on a medium, the medium is inserted through the wave guide into which electromagnetic waves are supplied by the electromagnetic wave supplying means. Therefore, the ink deposited on the medium is dried by the electromagnetic waves. Since the electromagnetic waves supplied by the electromagnetic wave supplying means are reflected by the reflector at the termination section after being propagated through the wave guide, the ink deposited on the medium is dried again with the reflected electromagnetic waves. In this manner, inside the wave guide, the ink deposited on the medium is dried with electromagnetic waves reflected by the reflector in addition to the electromagnetic waves directly supplied from the electromagnetic wave supplying means, thereby rapidly drying the ink.

In this case, it is preferable that the reflector is a reflection termination member for conducting reflection termination treatment of the electromagnetic waves supplied by the electromagnetic supplying means. Since the electromagnetic waves supplied by the electromagnetic wave supplying means are processed by the reflection termination treatment, most of electromagnetic waves delivered to the termination section are returned to the wave guide, thereby further effectively drying the ink.

It is preferable that the inkjet printer of the embodiment of the present invention further includes a propagation preventing means which is disposed between the electromagnetic wave supplying means and the reflection termination member to prevent the electromagnetic waves reflected by the reflection termination member from being propagated. According to the inkjet printer of the embodiment of the present invention, the electromagnetic waves supplied into the wave guide from the electromagnetic wave supplying means are reflected by the reflection termination member, but the reflected electromagnetic waves are prevented from being propagated to the electromagnetic wave supplying means because the propagation preventing means is disposed between the electromagnetic wave supplying means and the reflection termination member. Therefore, the electromagnetic wave supplying means is prevented from being broken due to the reflected electromagnetic waves.

Further, it is preferable that the reflection termination member is made of a metal. According to this inkjet printer of the embodiment of the present invention, the electromagnetic waves supplied into the wave guide are effectively reflected because the reflection termination member is made of a metal.

It is preferable that a first space is formed between an inner wall of the wave guide and the reflection termination member to have a certain length from an end of the reflection termination member on the electromagnetic wave supplying means side, wherein the certain length is ¼ of the wave length of the electromagnetic waves supplied into the wave guide. Since the first space is formed between the inner wall of the wave guide and the reflection termination member, the electromagnetic waves propagated to the termination section of the wave guide enter into the first space. Since the first space is formed to have a length of ¼ of the wave length of the electromagnetic waves supplied to the wave guide, the electromagnetic waves entering into the first space and the electromagnetic waves reflected at the terminal end of the first space create a phase shifting of ½ of the wave length of the electromagnetic waves so as to attenuate each other. Therefore, the electromagnetic waves supplied to the wave guide are prevented from penetrating the reflection termination member, thereby preventing electromagnetic waves from leaking from the wave guide.

Further, it is preferable that the reflection termination member has a second space which is formed to have a certain length from the terminal end of the first space, wherein the certain length is ¼ of the wave length of the electromagnetic waves supplied into said wave guide. According to the inkjet printer of the embodiment of the present invention, though the reflection termination member and the inner wall of the wave guide collide with each other at the end of the first space so as to produce a large contact resistance, the second space having a length of ¼ of the wave length of the electromagnetic waves supplied into the wave guide is formed from the terminal end of the first space so as to reduce impedance at the terminal end of the wave guide, thereby minimizing affect of contact resistance between the reflection termination member and the wave guide.

It is preferable that the inkjet printer of the embodiment of the present invention includes a sliding means for sliding the reflection termination member in the longitudinal direction of the wave guide. According to the inkjet printer of the embodiment of the present invention, though standing waves are generated in the wave guide because the electromagnetic waves supplied into the wave guide are reflected by the reflection termination member, the reflection termination member is slid in the longitudinal direction of the wave guide by the sliding means, thereby varying the standing waves, generated in the wave guide, in the longitudinal direction of the wave guide. Therefore, the power of electromagnetic waves is dispersed within the wave guide, thereby preventing unevenness of drying of ink deposited on the medium passed through the wave guide.

It is preferable that the sliding means slides the reflection termination member within a range of ½ of the wave length of the electromagnetic waves supplied to the wave guide. According to the inkjet printer of the embodiment of the present invention, the reflection termination member is slid within a range of ½ of wave length, thereby moving the peaks of standing waves of electromagnetic waves over the entire area of the wave guide. Therefore, unevenness of ink deposited on the medium passed through the wave guide is further prevented.

It is preferable that the reflector is a rotary reflector which reflects the electromagnetic waves supplied by the electromagnetic wave supplying means while rotating. Since the electromagnetic waves supplied by the electromagnetic wave supplying means are reflected by the rotary reflector at the termination section after being propagating inside the wave guide, ink deposited on the medium is dried again by the reflected electromagnetic waves. Since the reflection direction of electromagnetic waves reflected by the rotary reflector is changed because the rotary reflector is rotated, standing waves generated by the electromagnetic waves supplied by the electromagnetic supplying means and the electromagnetic waves reflected by the rotary reflector are varied. Therefore, peak positions of the standing waves are varied within the wave guide, thereby preventing unevenness of drying of ink deposited on the medium.

In this case, the rotary reflector is preferably rotated about a shaft perpendicular to the delivering direction of the electromagnetic waves. According to the inkjet printer of the embodiment of the present invention, the rotary reflector is rotated about the shaft perpendicular to the delivering direction of the electromagnetic waves, thereby effectively reflecting the electromagnetic waves supplied into the wave guide and allowing easy attachment of the rotary reflector to the wave guide.

It is preferable that the reflection termination member is disposed on the terminal end side of the rotary reflector in the wave guide. According to the inkjet printer, the electromagnetic waves not reflected by the rotary reflector and passed are processed by reflection termination treatment by the reflection termination member disposed at the termination side of the rotary reflector, thereby securely reflecting electromagnetic waves supplied by the electromagnetic wave supplying means and rapidly drying the ink deposited on the medium.

It is preferable that the rotary reflector is formed in a plate shape substantially the same as the shape of the internal section of the wave guide. According to the inkjet printer of the embodiment of the present invention, the rotary reflector is formed in a plate shape substantially the same as the shape of the internal section of the wave guide, thereby effectively reflecting electromagnetic waves supplied to the wave guide.

It is preferable that the distance between the reflector and the rotary reflector is $(n/2)\cdot\lambda g$ wherein "$\lambda g$" is the wave length of the electromagnetic waves supplied to the wave guide and "n" is an integer number equal to or more than 1. According to the inkjet printer of the embodiment of the present invention, the distance between the reflector and the rotary reflector is $(n/2)\cdot\lambda g$, thereby further effectively preventing unevenness of drying of ink deposited on the medium.

It is preferable that the inkjet printer of the embodiment of the present invention further includes a distance changing means for changing the distance between the reflector and the rotary reflector. According to the inkjet printer of the embodiment of the present invention, the distance between the reflector and the rotary reflector is changed, thereby changing the peak positions of standing waves generated in the wave guide. Therefore, the power of electromagnetic waves is dispersed within the wave guide, thereby preventing unevenness of drying of ink deposited on the medium passed through the wave guide.

It is preferable that the propagation preventing means is disposed between the electromagnetic wave supplying means and the rotary reflector. According to the inkjet printer of the embodiment of the present invention, the electromagnetic waves supplied into the wave guide from the electromagnetic wave supplying means are reflected by the rotary reflector, but the reflected electromagnetic waves are prevented from being propagated to the electromagnetic wave supplying means because the propagation preventing means is disposed between the electromagnetic wave supplying means and the rotary reflector. Therefore, the electromagnetic wave supplying means is prevented from being broken due to the reflected electromagnetic waves.

It is preferable that the rotary reflector is made of a metal. According to the inkjet printer of the embodiment of the present invention, the rotary reflector is made of a metal, thereby effectively reflecting the electromagnetic waves supplied to the wave guide.

In an inkjet printer using a wave guide, according to the embodiment of the present invention, it is capable of more rapidly drying ink deposited on a medium.

The embodiment of the present invention is applicable to an inkjet printer in which images and the like are formed by ejecting ink onto a medium. Obviously, numerous modifications and variations of the present invention are possible in light of the above teachings. It is therefore to be understood that within the scope of the appended claims, the invention may be practiced otherwise than as specifically described herein.

What is claimed is:

1. An inkjet printer comprising:

an ejector configured to eject ink toward a medium;

a wave guide through which the medium with the ink ejected by said ejector is inserted;

an electromagnetic wave supplier disposed at a start end of said wave guide to supply electromagnetic waves to said wave guide; and a reflector disposed at a terminal end of said wave guide to reflect the electromagnetic waves delivered by said wave guide in a first direction, said reflector comprising a reflection termination member to conduct reflection termination treatment of the electromagnetic waves supplied by said electromagnetic wave supplier, the reflection termination member having a reflective end surface and a side surface, the reflective end surface being provided to reflect, in a second direction opposite to the first direction, the electromagnetic waves delivered by said wave guide in the first direction, the side surface extending from the reflective end surface in the first direction and facing an inner wall of said wave guide to form a first space between the side surface of the reflection termination member and the inner wall of said wave guide, the first space having a length from the reflective end surface in the first direction, the length of the first space being ¼ of a wave length of the electromagnetic waves supplied into said wave guide.

2. The inkjet printer according to claim 1, further comprising a propagation preventer which is disposed between said electromagnetic wave supplier and said reflection termination member to prevent the electromagnetic waves reflected by said reflection termination member from being propagated.

3. The inkjet printer according to claim 1, wherein said reflection termination member comprises a metal.

4. The inkjet printer according to claim 1, wherein said reflection termination member has a second space which is formed to have a certain length from a terminal end of said first space, the certain length of the second space being ¼ of the wave length of the electromagnetic waves supplied into said wave guide.

5. The inkjet printer according to claim 1, further comprising a slider to slide said reflection termination member in a longitudinal direction of said wave guide.

6. The inkjet printer according to claim 5, wherein said slider is slidable on said reflection termination member within a range of ½ of the wave length of the electromagnetic waves supplied to said wave guide.

7. The inkjet printer according to claim 1, wherein said reflector comprises a rotary reflector to reflect the electromagnetic waves supplied by said electromagnetic wave supplier while rotating.

8. The inkjet printer according to claim 7, wherein said rotary reflector is rotatable about a shaft perpendicular to a delivering direction of the electromagnetic waves.

9. The inkjet printer according to claim 7, wherein said reflection termination member is disposed on a terminal end side of said rotary reflector in said wave guide.

10. The inkjet printer according to claim 7, wherein said rotary reflector is formed in a substantially same plate shape as a shape of an internal section of said wave guide.

11. The inkjet printer according to claim 9, wherein a distance between said reflection termination member and said rotary reflector is $(n/2)\cdot\lambda g$ wherein $\lambda g$ is a wave length of the electromagnetic waves supplied to said wave guide and n is an integer number equal to or more than 1.

12. The inkjet printer according to claim 9, further comprising a distance changer to change the distance between said reflection termination member and the rotary reflector.

13. The inkjet printer according to claim 7, further comprising a propagation preventer which is disposed between said electromagnetic wave supplier and said reflection termination member to prevent the electromagnetic waves reflected by said reflection termination member from being propagated, wherein said propagation preventer is disposed between said electromagnetic wave supplier and said rotary reflector.

14. The inkjet printer according to claim 7, wherein said rotary reflector comprises a metal.

15. The inkjet printer according to claim 2, wherein said reflection termination member comprises a metal.

16. The inkjet printer according to claim 1, wherein the reflective end surface is smaller than a cross-sectional area of a delivering path provided in said wave guide.

17. The inkjet printer according to claim 1, wherein the reflective end surface is perpendicular to the first direction.

* * * * *